US005470401A

United States Patent [19]

McCallum et al.

[11] Patent Number: 5,470,401

[45] Date of Patent: Nov. 28, 1995

[54] METHOD OF MAKING BONDED OR SINTERED PERMANENT MAGNETS

[75] Inventors: R. William McCallum; Kevin W. Dennis; Barbara K. Lograsso; Iver E. Anderson, all of Ames, Iowa

[73] Assignee: Iowa State University Research Foundation, Inc., Ames, Iowa

[21] Appl. No.: 97,442

[22] Filed: Jul. 26, 1993

Related U.S. Application Data

[62] Division of Ser. No. 593,943, Oct. 9, 1990, Pat. No. 5,240, 513.

[51] Int. Cl.[6] ..... H01F 1/057

[52] U.S. Cl. ..... 148/302; 252/62.54; 75/244; 148/301

[58] Field of Search ..... 148/302, 301; 252/62.54; 75/244

[56] References Cited

U.S. PATENT DOCUMENTS

| | | | |
|---|---|---|---|
| 3,663,317 | 5/1972 | Westendorp et al. | 148/103 |
| 4,104,787 | 8/1978 | Jandeska et al. | 29/596 |
| 4,290,826 | 9/1981 | Clegg | 148/101 |
| 4,402,770 | 9/1983 | Koon | 148/31.57 |
| 4,462,919 | 7/1984 | Saito | 252/62.54 |
| 4,533,408 | 8/1985 | Koon | 148/103 |
| 4,585,473 | 4/1986 | Narasimhan et al. | 75/0.5 C |
| 4,597,938 | 7/1986 | Matsuura et al. | 419/23 |
| 4,601,875 | 7/1986 | Yamamoto et al. | 419/23 |
| 4,619,845 | 10/1987 | Ayers et al. | 427/422 |
| 4,636,353 | 1/1987 | Seon et al. | 420/416 |
| 4,664,724 | 5/1987 | Mizoguchi et al. | 148/302 |
| 4,770,723 | 9/1988 | Sagawa et al. | 148/302 |
| 4,801,340 | 1/1989 | Inoue et al. | 148/103 |
| 4,802,931 | 2/1989 | Croat | 148/302 |
| 4,834,812 | 5/1989 | Ghandehari | 148/101 |
| 4,837,114 | 6/1989 | Hamada et al. | 148/302 |
| 4,867,809 | 9/1989 | Haverstick | 148/101 |
| 4,911,882 | 3/1990 | Greenwald | 419/12 |
| 4,988,755 | 1/1991 | Dickens et al. | 252/62.54 |
| 5,114,502 | 5/1992 | Bogatin | 148/302 |

OTHER PUBLICATIONS

Permanent Magnet Materials Based On The Rare Earth–Iron–Boron Tetragonal Compounds, M. Sagawa et al, IEE Transactions on Magnetics, Sep. 1984, pp. 1584–1589.

New material for permanent magnets on a base of Nd and Fe, M. Sagawa et al, American Institute of Physics, 1984, Mar., pp. 2083–2087.

Materials Research for Advanced Inertial Instrumention, D. Das et al 1978, Rare Earth Magnetic Material Technology as Related to Gyro Torquers and Motors (Tech. Bulletin No. 3, Charles Starhen, Lab. Inc.

Low oxygen processing of $SmCo_5$ magnets, K.S.V.L. Narasimhan, J. Appl. Phys., 1981, Mar., pp. 2512–2514.

Fluid Flow Effects In Gas Atomization Processing, I. E. Anderson et al, International Symposium on the Physical Chemistry of Powder Metals Production and Processing, 1989.

Observatoins Of Gas Atomization Process Dynamics, I. E. Anderson et al, MPIF–AMPI, 1988, p. 205.

Hot–pressed neodymium–iron–boron magnets, R. W. Lee, Appl. Phys. Lett. 1985, pp. 790–791.

(List continued on next page.)

*Primary Examiner*—John Sheehan

*Attorney, Agent, or Firm*—Edward J. Timmer

[57] ABSTRACT

An isotropic permanent magnet is made by mixing a thermally responsive, low viscosity binder and atomized rare earth-transition metal (e.g., iron) alloy powder having a carbon-bearing (e.g., graphite) layer thereon that facilitates wetting and bonding of the powder particles by the binder. Prior to mixing with the binder, the atomized alloy powder may be sized or classified to provide a particular particle size fraction having a grain size within a given relatively narrow range. A selected particle size fraction is mixed with the binder and the mixture is molded to a desired complex magnet shape. A molded isotropic permanent magnet is thereby formed. A sintered isotropic permanent magnet can be formed by removing the binder from the molded mixture and thereafter sintering to full density.

8 Claims, 12 Drawing Sheets

OTHER PUBLICATIONS

Iron–based rare–earth magnets, J. J. Croat, Chairperson, J. Appl. Phys. 1985 pp. 4081–4085.
Nd–Fe–B Permanent Magnet Materials, Japanese Journal of Applied Science, 1987, Masato Sagawa et al Jun. pp. 785–800.
Processing of Neodymium–Iron–Boron Melt–Spun Ribbons To Fully Dense Magnets, R. W. Lee et al, IEE Transactions on Magnetics, 1985, pp. 1958–1963.
Flow Measurements in Gas Atomization Processes, R. S. Figliola, et al 1989, pp. 39–47.
The Metal Injection Molding Process Comes of Age, Barry H. Rosof, J. of The Minerals, Metals & Materials Society, Barry H. Rosof, 1989, Aug. pp. 13–16.
Metal–Filled Polymers, edited by S. K. Bhattacharya, 1986 pp. 1–13 and 97–105.
Metals Handbook, vol. 7, "Powder Metallurgy", 1984 pp. 495–520.
Powder Injection Molding, R. M. German, 1990 pp. 1–17.

800X

1000X

ETCHED
WITH NITAL

1000X

UNETCHED

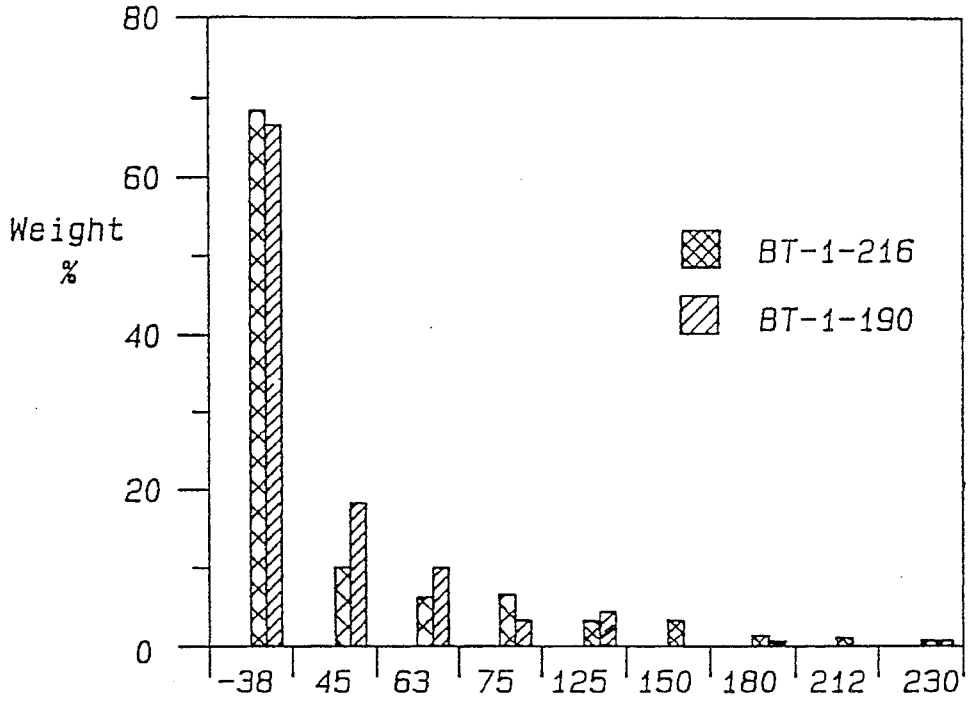
Fig-6 Particle Size (um)
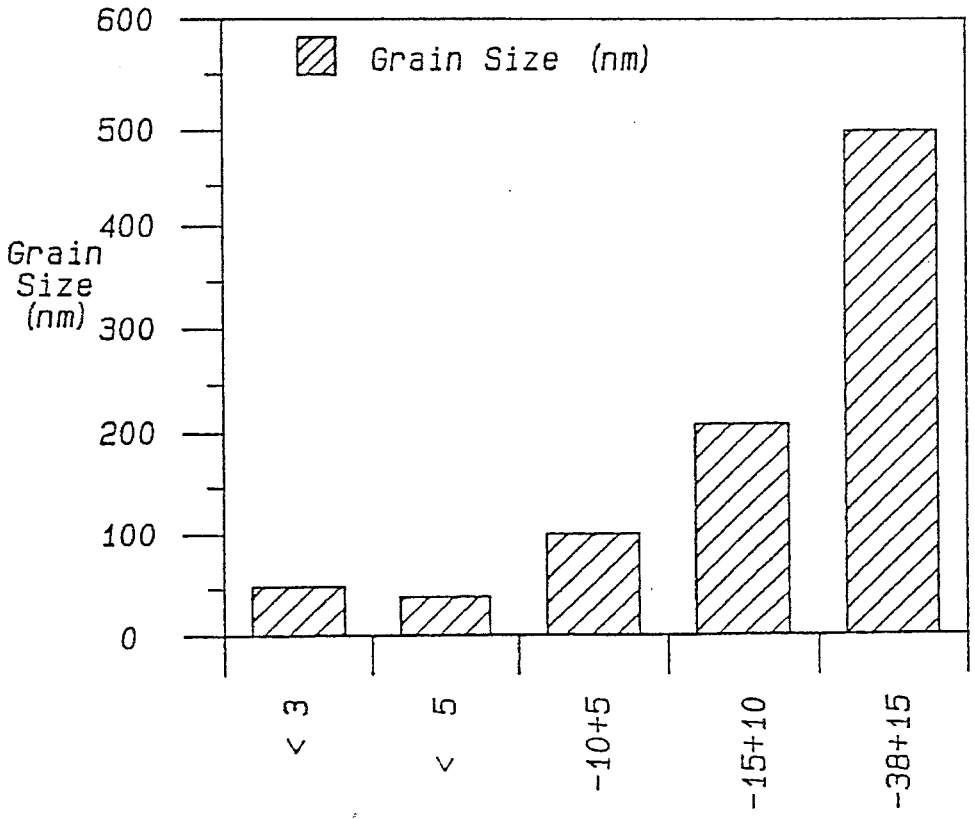
Fig-9 Particle Size (um)

$r_2 - r_0 = 2.5(r_1 - r_0)$

METHOD OF MAKING BONDED OR SINTERED PERMANENT MAGNETS

CONTRACTUAL ORIGIN OF REFERENCE AND GRANT REFERENCE

The United States Government has rights in this invention pursuant to the Contract No. W-7405-ENG-82 between the U.S. Department of Energy and Iowa State University, Ames, Iowa, which contract grants to Iowa State University Research Foundation,. Inc. the right to apply for this patent. The research leading to the invention was supported in part by U.S. Department of Commerce Grant ITA 87-02. This is a division of Ser. No. 07/593 943, filed Oct. 9, 1990 now U.S. Pat. No. 5,240,513.

FIELD OF THE INVENTION

The present invention relates to binder-assisted fabrication of permanent isotropic magnets and, more particularly, to a method of making permanent isotropic magnets by heat molding mixtures of a binder and an atomized rare earth-transition metal alloy powder and to magnets thereby produced.

BACKGROUND OF THE INVENTION

A large amount of technological interest has been focused on rare earth-iron-boron alloys (e.g., 26.7 weight % Nd-72.3 weight % Fe-1.0 weight % B) as a result of their promising magnetic properties for permanent magnet applications attributable to the magnetically hard $Nd_2Fe_{14}B$ phase. Commercial permanent magnets of these alloys having anisotropic, aligned structure exhibit high potential energy products (i.e., BHmax) of 40–48 MGOe while those having anisotropic, non-aligned structure exhibit potential energy products of 5–10 MGOe. Such energy product levels are much higher than those exhibited by Sm-Co alloys (e.g., $SmCo_5$ and $Sm_2Co_{17}$) previously regarded as having optimum magnetic properties. The rare earth-iron-boron alloys are also advantageous over the SmCo alloys in that the rare earth (e.g., Nd) and Fe are much more abundant and economical than Sm and Co. As a result, rare earth-iron-boron permanent magnets are used in a wide variety of applications including, but not limited to, audio loud speakers, electric motors, generators, meters, scientific instruments and the like.

Several distinct processes have been disclosed to fabricate fully dense, permanent magnets from Nd-Fe-B alloys. One process involves forming a rapidly solidified, nearly amorphorous ribbon, mechanically comminuting the ribbon to form flake particulates and then hot pressing and aligning the flake particulates at elevated temperature in a die cavity. Another process involves grinding the Nd-Fe-B alloy into fine powder, aligning the powder in a magnetic field during cold pressing, and sintering the cold pressed powder to near full density. These processes have been employed to make aligned (i.e., anisotropic) permanent magnets.

Resin bonding of rapidly solidified ribbon of Nd-Fe-B alloys has been proposed by R. W. Lee in an article entitled "Hot-pressed Neodymium-iron-boron Magnets", Appl. Phys. Lett. 46: pp. 790–791 (1985) as a technique for fabricating isotropic permanent magnets. In order to make resin bonded magnets from rapidly solidified, melt-spun ribbon, it is necessary to comminute the friable ribbon into flake particulates and then to compact the particulates under pressure to a desired shape of simple geometry in a compression molding die. The voids of the compact are typically filled with a liquid polymer, such as epoxy and the like, to form a bonded magnet.

It is an object of the present invention to provide a method of making isotropic permanent magnets from rare earth-transition metal alloys using a unique alloy powder/binder feedstock blend or mixture that facilitates molding of the mixture at relatively low temperatures to previously unachievable or difficult-to-achieve complex shapes.

It is another object of the present invention to provide a method of making isotropic permanent magnets from rare earth-transition metal alloys wherein low viscosity binder-assisted molding permits relatively low temperature molding of the feedstock blend or mixture having optimum volume loading of atomized alloy powder for a particular application.

It is still another object of the present invention to provide isotropic permanent magnets molded from the alloy powder/binder feedstock blend or mixture.

SUMMARY OF THE INVENTION

The present invention involves a method of making isotropic permanent magnets by mixing a thermally responsive, low viscosity binder and rare earth-transition metal alloy powder particles which have a carbon-bearing layer thereon that facilitates wetting of the powder particles by the binder. The mixture is then molded to a three dimensional shape.

In one embodiment of the invention, the powder particulates are formed by atomizing a melt of rare earth-transition metal alloy to form generally spherical, rapidly solidified alloy particles. The atomized particles are contacted with a carbonaceous material to form the carbon-bearing layer (typically graphite) in-situ thereon in the atomizing apparatus. The powder particulates are typically size classified into one or more particle size fractions (or classes) such that the particles of each size fraction exhibit a grain size in a given range and thus generally uniform isotropic magnetic properties. The mixture of sized rare earth-transition metal alloy particulates and the binder are molded, preferably injection molded, to complex three dimensional shapes.

The binder is selected from a variety of polymeric materials which are thermoplastic or thermosetting and which exhibit low viscosity and other rheological properties under the molding conditions employed to form the magnet shape so as to readily wet and adhere to the carbon-bearing layer present on the alloy powder particles. A preferred binder comprises a blend or mixture of a high melt flow binder (e.g., short chain low molecular weight polyethylene) with a stronger, moderate melt flow binder (clarity low molecular weight polyethylene) in suitable proportions such as, for example, a 2-to-1 mixture by volume.

The binder/alloy powder mixture provides a low viscosity feedstock that is heat molded to a desired complex magnet shape. Preferably, the feedstock mixture is molded at relatively low temperature corresponding to the melting temperature of the lowest melting point binder. Other molding techniques, such as blow molding, extrusion, transfer molding, rotational molding, compression molding, stamping and other low temperature/viscosity processes can be employed in practicing the invention.

The presence of the carbon-bearing layer on the atomized alloy powder improves wetting and bonding of the alloy powder by the low viscosity binder in the aforementioned molding processes. Moreover, use of fine, spherical alloy powder produced by the atomization process permits high volume loading of the magnetic alloy powder in the binder, if desired, to provide improved magnetic properties.

Permanent magnets in accordance with the invention are produced as bonded isotropic magnets or, alternately, as sintered, binderless isotropic magnets. In particular, the bonded magnets of the invention retain the binder as a matrix for the alloy powder. On the other hand, manufacture of sintered magnets in accordance with the invention involves removing the binder after the molding operation and then sintering to near full density.

The method of the invention can be used to economically produce isotropic permanent magnets of desired microstructure and thereby desired magnetic properties by appropriate selection of (a) the initial particle size fraction of the atomized alloy powder, (b) the volume loading of the magnetic alloy powder in the binder, and (c) optional post-molding treatments such as binder removal/sintering to which the molded shape may be subjected.

BRIEF DESCRIPTION OF THE DRAWINGS

FIG. 4A is etched with Nital while FIG. 4B is unetched.

FIG. 6 is a bar graph illustrating the distribution in weight % of particles as a function of particle size (diameter).

FIG. 9 is a bar graph for Nd-Fe-B alloy particles illustrating particle grain size as a function of particle size.

DETAILED DESCRIPTION OF THE INVENTION

Figure 1:
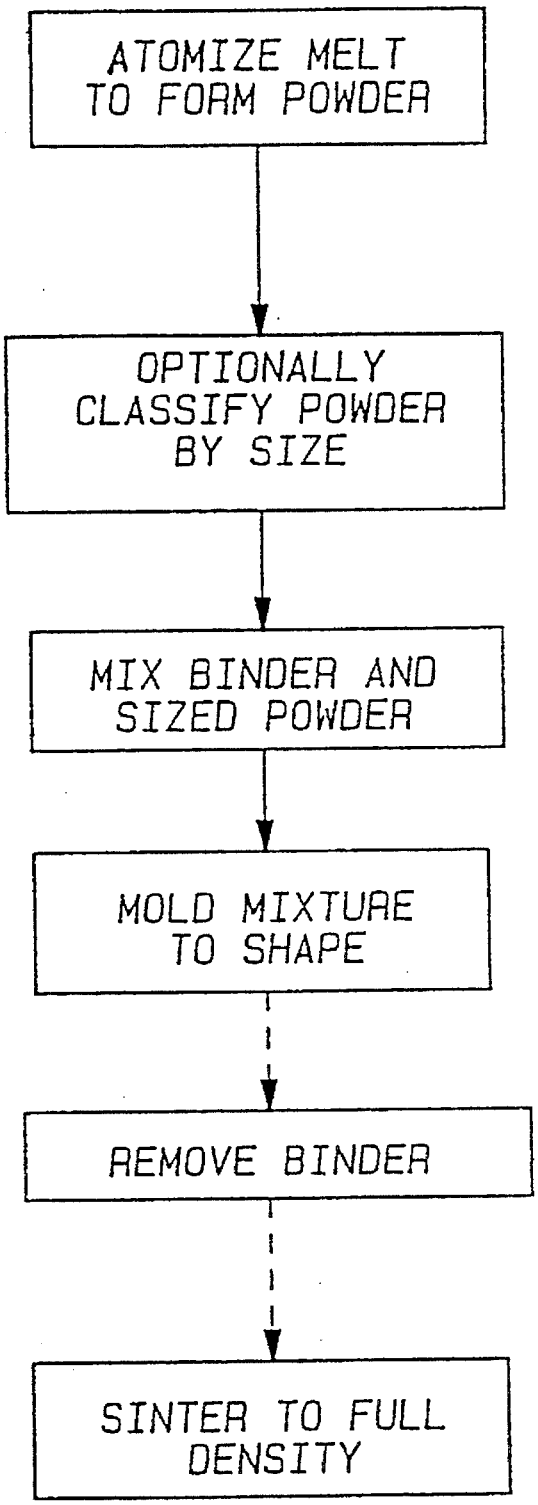
FIG. 1 is a flow sheet illustrating the sequential method steps of one embodiment of the invention.

Referring to FIG. 1, the various steps involved in practicing one particular embodiment of the method of the invention are illustrated. In this particular embodiment of the invention, a melt of the appropriate rare earth-transition metal alloy is atomized by a high pressure inert gas process of the type described in copending, commonly assigned U.S. patent application Ser. No. 594,088 entitled "Environmentally Stable Reactive Alloy Powders And Method Of Making Same" (now abandoned) to produce fine, environmentally stable, generally spherical, rapidly solidified powder particles of the rare earth-transition metal alloy. The rapid solidification rate that is achieved during his inert gas atomization process is similar to that achieved in melt spinning in so far as there is a beneficial reduction in alloy constituent segregation during freezing, particularly as compared to the coarse segregation patterns evident in chill cast ingots.

Figure 2:
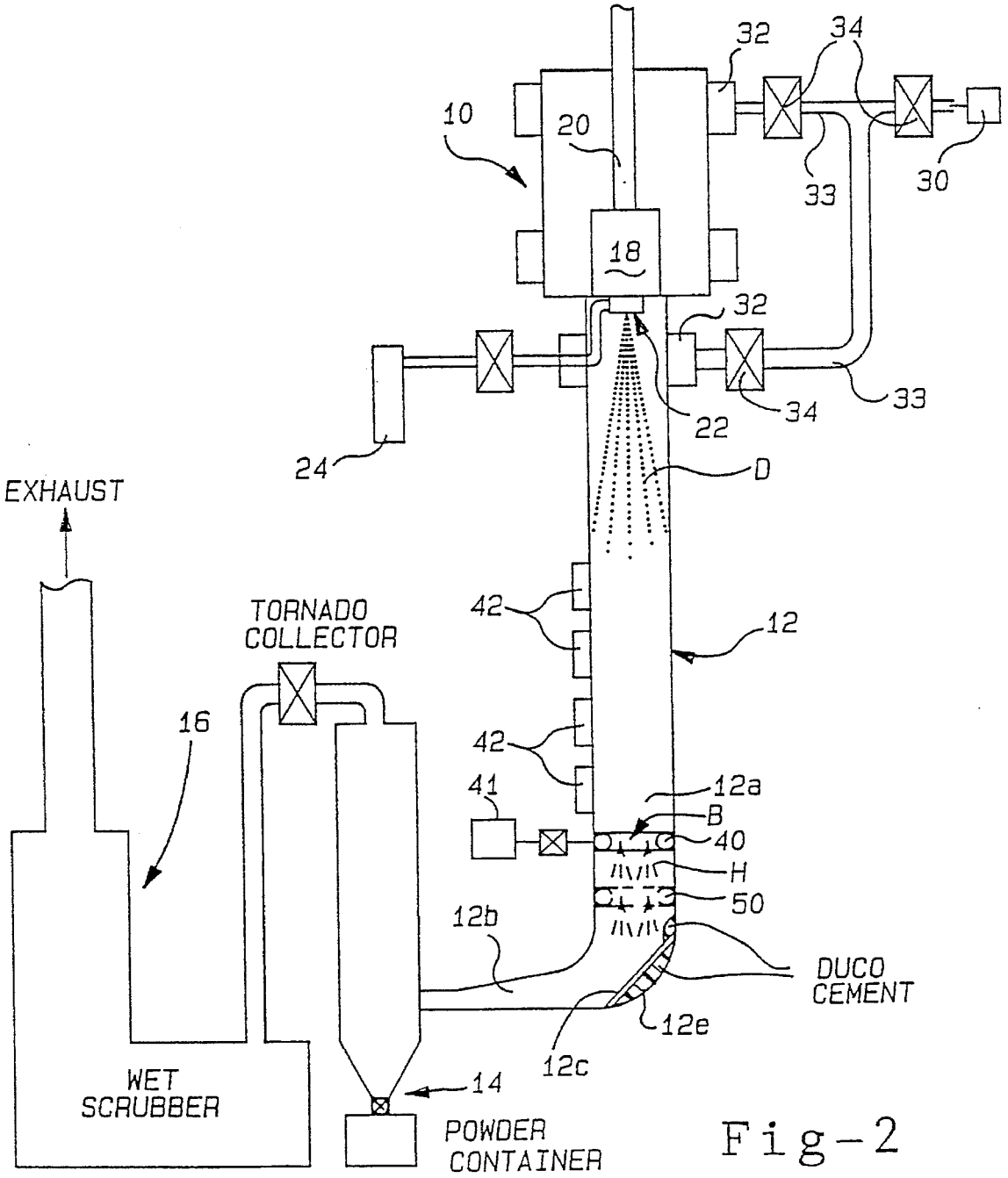
FIG. 2 is a schematic view of apparatus for practicing one embodiment of the invention.
Figure 3:
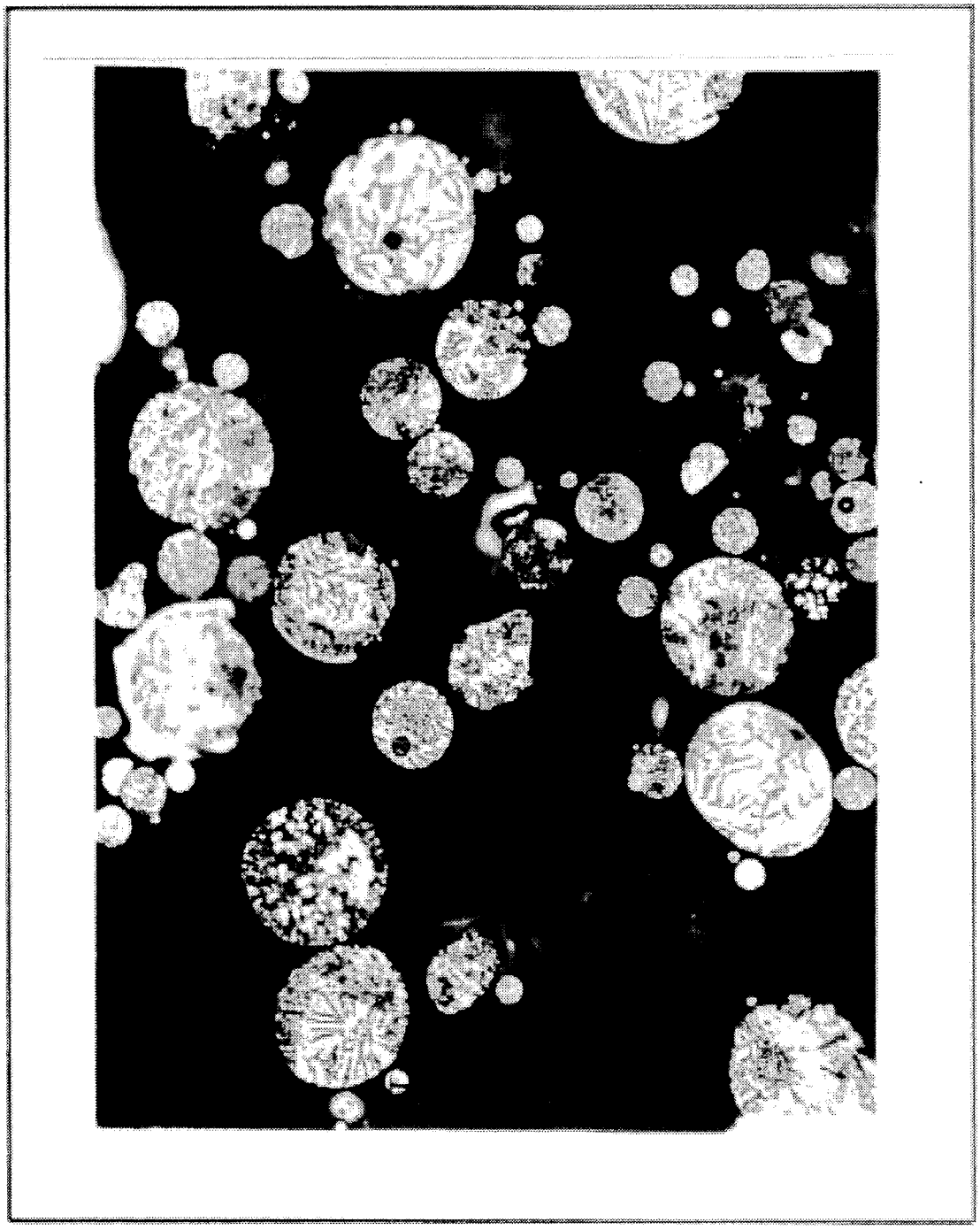
FIG. 3 is photomicrograph at 800× of a batch of rapidly solidified powder particles classified into a size fraction of less than 15 microns.

Referring to FIG. 2, a gas atomization apparatus is shown for atomizing the melt in accordance with the aforementioned high pressure inert gas atomization process. The apparatus includes a melting chamber 10, a drop tube 12 beneath the melting chamber, a powder separator/collection chamber 14 and a gas exhaust cleaning system 16. The melting chamber 10 includes an induction melting furnace 18 and a vertically movable stopper rod 20 for controlling flow of melt from the furnace 18 to a melt atomizing nozzle 22 disposed between the furnace and the drop tube. The atomizing nozzle 22 preferably is of the general supersonic inert gas type described in the Ayers and Anderson U.S. Pat. No. 4,619,845, the teachings of which are incorporated herein by reference, as modified in the manner described in Example 1. The atomizing nozzle 22 is supplied with an inert atomizing gas (e.g., argon, helium) from a suitable source 24, such as a conventional bottle or cylinder of the appropriate gas. As shown in FIG. 2, the atomizing nozzle 22 atomizes the melt in the form of a spray of generally spherical, molten droplets D discharged into the drop tube 12.

Both the melting chamber 10 and the drop tube 12 are connected to an evacuation device (e.g., vacuum pump) 30 via suitable ports 32 and conduits 33. Prior to melting and atomization of the melt, the melting chamber 10 and the drop tube 12 are evacuated to a level of $10^{-4}$ atmosphere to substantially remove ambient air. Then, the evacuation system is isolated from the chamber 10 and the drop tube 12 via the valves 34 shown and the chamber 10 and drop tube 12 are positively pressurized by an inert gas (e.g., argon to about 1.1 atmosphere) to prevent entry of ambient air thereafter.

The drop tube 12 includes a vertical drop tube section **12*a* and a lateral section 12*b* that communicates with the powder collection chamber 14. The drop tube vertical section 12*a* has a generally circular cross-section having a diameter in the range of 1 to 3 feet, a diameter of 1 foot being used in the Examples set forth below. As will be explained below, the diameter of the drop tube section 12*a* and the diameter of the supplemental reactive gas jet 40 are selected in relation to one another to provide a reactive gas zone or halo H extending substantially across the cross-section of the drop tube vertical section 12*a*** at the zone H.

The length of the vertical drop tube section **12*a* is typically about 9 to about 16 feet, a preferred length being 9 feet being used in the Examples set forth below, although other lengths can be used in practicing the invention. A plurality of temperature sensing means 42 (shown schematically), such as radiometers or laser doppler velocimetry devices, may be spaced axially apart along the length of the vertical drop section 12*a*** to measure the temperature of the atomized droplets D as they fall through the drop tube and cool in temperature.

The supplemental reactive gas jet 40 referred to above is disposed at location along the length of the vertical drop section 12*a* where the falling atomized droplets D have cooled to a reduced temperature (compared to the droplet melting temperature) at which the droplets have at least a solidified exterior surface thereon and at which the reactive gas in the zone H can react with one or more reactive alloying elements of the shell to form a protective barrier layer.(reaction product layer comprising a refractory compound of the reactive alloying element) on the droplets whose depth of penetration into the droplets is controllably limited by the presence of the solidified surface as will be described below.

In particular, the jet 40 is supplied with reactive gas (e.g., nitrogen) from a suitable source 41, such as a conventional bottle or cylinder of appropriate gas, through a valve and discharges the reactive gas in a downward direction into the drop tube to establish the zone or halo H of reactive gas through which the droplets travel and come in contact for reaction in-situ therewith as they fall through the drop tube. The reactive gas is preferably discharged downwardly in the drop tube to minimize gas updrift in the drop tube 12. The flow patterns established in the drop tube by the atomization and falling of the droplets inherently oppose updrift of the reactive gas. As a result, a reactive gas zone or halo H having a more or less distinct upper boundary B and less distinct lower boundary extending to the collection chamber 14 is established in the drop tube section 12*a* downstream from the atomizing nozzle in FIG. 2. As mentioned above, the diameter of the drop tube section 12*a* and the jet 40 are selected in relation to one another to establish a reactive gas zone or halo that extends laterally across the entire drop tube cross-section. This places the zone H in the path of the falling droplets D so that substantially all of the droplets travel therethrough and contact the reactive gas.

The temperature of the droplets D as they reach the reactive gas zone H will be low enough to form at least a solidified exterior surface thereon and yet sufficiently high as to effect the desired reaction between the reactive gas and the reactive alloying element(s) of the droplet composition. The particular temperature at which the droplets have at least a solidified exterior shell will depend on the particular melt composition, the initial melt superheat temperature, the cooling rate in the drop tube, and the size of the droplets as well as other factors such as the "cleanliness" of the droplets; i.e., the concentration and potency of heterogeneous catalysts for droplet solidification.

Preferably, the temperature of the droplets when they reach the reactive gas zone H will be low enough to form at least: a solidified exterior skin or shell of a detectable, finite shell thickness; e.g., a shell thickness of at least about 0.5 micron. Even more preferably, the droplets are solidified from the exterior surface substantially to the droplet core (i.e., substantially through their diametral cross-section) when they reach the reactive gas zone H. As mentioned above, radiometers or laser doppler velocimetry devices, may be spaced axially apart along the length of the vertical drop section 12*a* to measure the temperature of the atomized droplets D as they fall through the drop tube and cool in temperature, thereby sensing or detecting when at least a solidified exterior shell of finite thickness has formed on the droplets. The formation of a finite solid shell on the droplets can also be readily determined using a physical sampling technique in conjunction with macroscopic and microscopic examination of the powder samples taken at different axial locations downstream from the atomizing nozzle in the drop tube 12. This technique is disclosed in aforementioned copending U.S. patent application Ser. No. 594,088, (now abandoned).

Referring to FIG. 2, prior to atomization, a thermally decomposable organic material is deposited on a splash member 12*c* disposed at the junction of the drop tube vertical section 12*a* and lateral section 12*b* to provide sufficient gaseous carbonaceous material in the drop tube sections 12*a*,12*b* below zone H as to form a carbon-bearing (e.g., graphite) layer on the hot droplets D after they pass through the reactive gas zone H. The organic material may comprise an organic cement to hold the splash member 12*c* in place in the drop tube 12. Alternately, the organic material may simply be deposited on the upper surface or lower surface of the splash member 12*c*. In any event, the material is heated during atomization to thermally decompose it and release gaseous carbonaceous material into the drop tube sections 12*a*,12*b* below zone H. An exemplary organic material for use comprises Duco® model cement that is applied in a uniform, close pattern to the bottom of the splash member 12*c* to fasten it to the elbow 12*b*. Also, the Duco cement is applied as a heavy bead along the exposed uppermost edge of the splash member 12*c* after the initial fastening to the elbow. The Duco organic cement is subjected during atomization to temperatures in excess of 500° C. so that the cement is thermally decomposed and acts as a source of gaseous carbonaceous material to be released into the drop tube sections 12*a*,12*b* beneath the zone H. The extent of heating and thermal decomposition of the cement and, hence, the concentration of carbonaceous gas available for powder coating is controlled by the position of the splash member 12*c*, particularly the exposed uppermost edge, relative to the initial melt splash impact region and the central zone of the spray pattern. To maximize the extent of heating and thermal decomposition, additional Duco cement can be laid down (deposited) as stripes on the upper surface of the splash member 12*c*.

Alternately, a second supplemental jet 50 is shown disposed downstream of the first supplemental reactive gas jet 40. The second jet 50 is provided to receive a carbonaceous material, such as methane, argon laced with paraffin oil and the like, from a suitable source (not shown) for discharge into the drop tube section 12*a* to form the carbonaceous (e.g., graphitic carbon) coating or layer on the hot droplets D after they pass through the reactive gas zone H.

Powder collection is accomplished by separation of the powder particles/gas exhaust stream in the tornado centrifugal dust separator/collection chamber 14 and by retention of separated powder particles in the valved particle-receiving container, FIG. 2.

In practicing the present invention using the apparatus of FIG. 2, the melt may comprise various rare earth-transition metal alloys selected to achieve desired isotropic magnetic properties. The rare earth-transition metal alloys typically include, but are not limited to, Tb-Ni, Tb-Fe and other refrigerant magnetic alloys and rare earth-iron-boron alloys described in U.S. Pat. Nos. 4,402,770; 4,533,408; 4,597,938 and 4,802,931, the teachings of which are incorporated herein by reference, where the rare earth is selected from one,or more of Nd, Pr, La, Tb, Dy, Sm, Ho, Ce, Eu, Gd, Er, Tm, Yb, Lu, Y, and Sc. The lower weight lanthanides (Nd, Pr, La, Sm, Ce, Y, Sc) are preferred. Rare earth-iron-boron alloys, especially Nd-Fe-B alloys comprising about 26 to 36 weight % Nd, about 62 to 68 weight % Fe and 0.8 to 1.6 weight % B, are preferred in practicing the invention as a result of their demonstrated excellent magnetic properties.

Rare earth-iron-boron alloys rich in rare earth (e.g., at least 27 weight %) and rich in boron (e.g., at least 1.1 weight %) are preferred to promote formation of the hard magnetic phase, $Nd_2Fe_{14}B$, in an equiaxed, blocky microstructure, and minimize, preferably avoid, formation of the ferritic Fe phase in all particle sizes produced. The Nd-Fe-B alloys rich in Nd and B were found to be substantially free of primary ferritic Fe phase, which was observed in some particle sizes (e.g., 10 to 20 microns) for Fe rich and near-stoichiometric alloy compositions. Alloyants such as Co, Ga, La, and others may be included in the alloy composition, such as 31.5 weight % Nd- 65.5 weight % Fe- 1.408 weight % B- 1.592 weight % La and 32.6 weight % Nd- 50.94 weight % Fe- 14.1 weight % Co- 1.22 weight % B- 1.05 weight % Ga.

In the case of the rare earth-transition metal-boron alloys, the rare earth and boron are reactive alloying elements that must be maintained at prescribed concentrations to provide desired magnetic properties in the powder product.

The reactive gas may comprise a nitrogen bearing gas, oxygen bearing gas, carbon bearing gas and the like that will form a stable reaction product comprising a refractory compound, particularly an environmentally protective barrier layer, with the reactive alloying element of the melt composition. Illustrative of stable refractory reaction products are nitrides, oxides, carbides, borides and the like. The particular reaction product formed will depend on the composition of the melt, the reactive gas composition as well as the reaction conditions existing at the reactive gas zone H. The protective barrier (reaction product) layer is selected to provide protection against environmental constituents, such as air and water in the vapor or liquid form, to which the powder product will be exposed during subsequent fabrication to an end-use shape and during use in the intended service application.

The depth of penetration of the reaction product layer into the droplets is controllably limited by the droplet temperature (extent of exterior shell solidification) and by the reaction conditions established at the reactive gas zone H. In particular, the penetration of the reaction product layer (i.e., the reactive gas species, for example, nitrogen) into the droplets is limited by the presence of the solidified exterior shell so as to avoid selective removal of the reactive alloying element (by excess reaction therewith) from the droplet core composition to a harmful level (i.e., outside the preselected final end-use concentration limits) that could substantially degrade the end-use properties of the powder product. For example, with respect to the rare earth-transition metal-boron alloys, the penetration of the reaction product layer is limited to avoid selectively removing the rare earth and the boron alloyants from the droplet core composition to a harmful level (outside the prescribed final end-use concentrations therefor) that would substantially degrade the magnetic properties of the powder product in magnet applications. In accordance with the invention, the thickness of the reaction product layer formed on rare earth-transition metal-boron alloy powder is limited so as not to exceed about 500 angstroms, preferably being in the range of about 200 to about 300 angstroms, for powder particle sizes in the range of about 1 to about 75 microns, regardless of the type of reaction product layer formed. Generally, the thickness of the reaction product layer does not exceed 5% of the major coated powder particle dimension (i.e., the particle diameter) to this end.

The reaction barrier (reaction product) layer may comprise multiple layers of different composition, such as an inner nitride layer formed on the droplet core and an outer oxide type layer formed on the inner layer. The types of reaction product layers formed again will depend upon the melt composition and the reaction conditions present at the reactive gas zone H.

As mentioned above, a carbon-bearing (graphitic carbon) layer is formed in-situ on the reaction product layer by various techniques. Such a graphitic carbon layer is formed to a thickness of at least about 1 monolayer (2.5 angstroms) regardless of the technique employed. The layer provides protection to the powder product against such environmental constituents as liquid water or water vapor as, for example, is present in humid air. Importantly, the layer also facilitates wetting of the powder product by polymer binders, such as polyolefins (e.g., polyethylenes) as described below in injection molding of the binder/alloy powder mixtures to form complex, end-use magnet shapes.

The invention is not limited to the particular high pressure inert gas atomization process described in the patent and may be practiced using other atomization nozzles, such as annular slit, close-coupled nozzles or conventional free-fall nozzles that yield rapidly solidified powder having appropriate sizes for use in the fabrication of isotropic permanent magnets.

Figure 5:
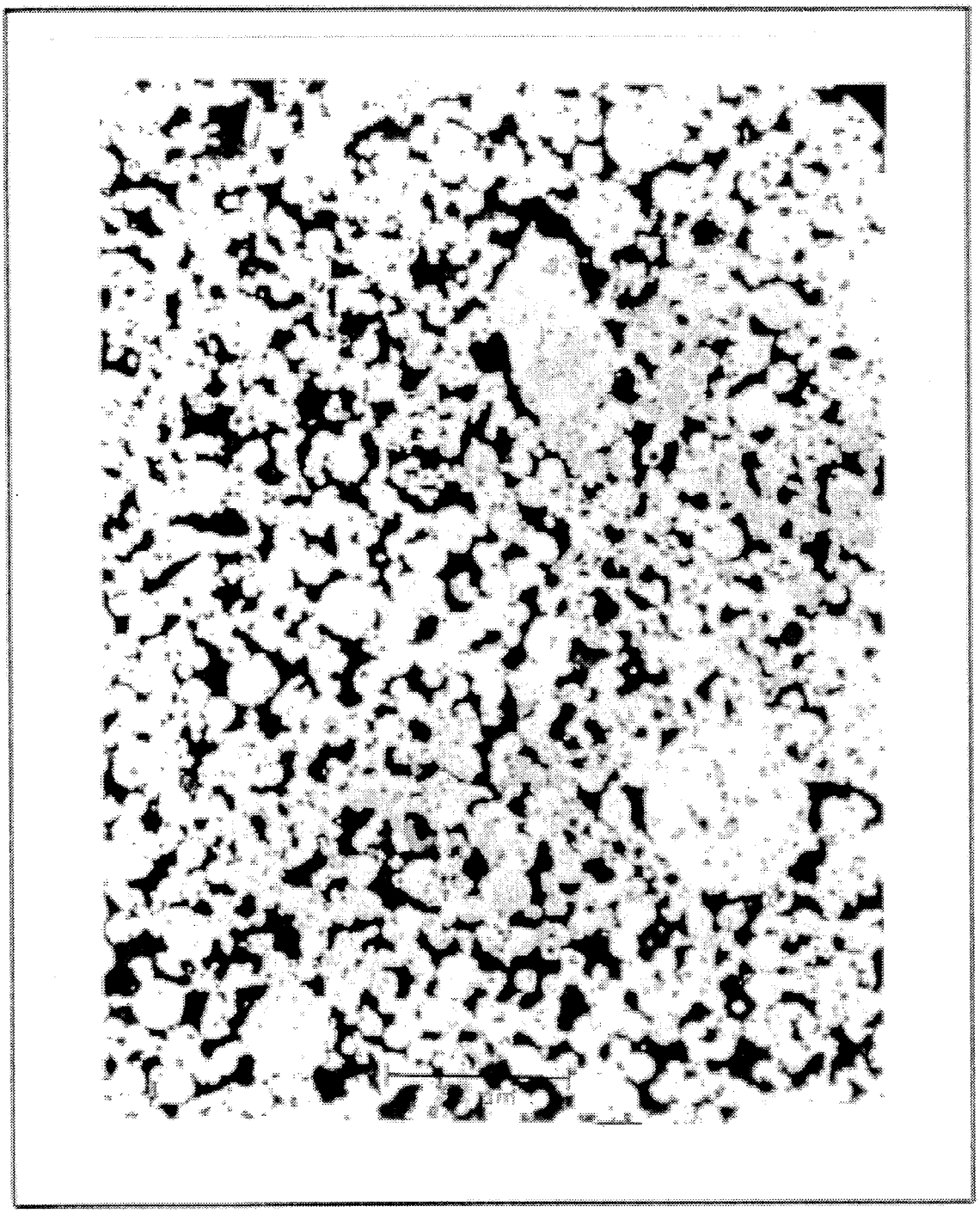
FIG. 5 is a photomicrograph at 400× of a section of a sintered, binderless isotropic permanent magnet made in accordance with Example 2 and exhibiting a homogeneous microstructure and isotropic magnetic properties.

Referring to FIG. 1, one embodiment of the invention involves producing environmentally stable, generally spherical, rapidly solidified powder particles using the high pressure inert gas atomization process/apparatus described in Example 1 such that the rare earth-transition metal alloy particles fall within a given particle size (diameter) range (and thus within a given grain size range) wherein the majority of the particles exhibit particle diameters less than a given diameter determined to exhibit desirable magnetic properties for the particular alloy composition and magnet service application involved. For example, in practicing the invention to make Nd-Fe-B alloy magnets, the powder particles produced using the high pressure inert gas atomization process/apparatus typically fall within a particle size (diameter) range of about 1 micron to about 100 microns with a majority (e.g., 66–68% by weight) of the particles having a diameter less than about 44 microns, typically from about 3 to about 44 microns. Preferably, a majority of the particles are less than about 38 microns in diameter, a particle size found to yield optimum magnetic properties in the as-atomized condition as will become apparent below. FIG. 5 illustrates in bar graph form a typical distribution in weight % of two batches of Nd-Fe-B-La alloy particles as a function of particle size. The composition (in weight %) of the alloys before atomization is set forth below in the Table:

TABLE

| | Nd | Fe | B | La |
|---|---|---|---|---|
| Alloy BT-1-190 | 31.51 | 65.49 | 1.32 | 1.597 |
| Alloy BT-1-216 | 33.07 | 63.93 | 1.32 | 1.68 |

Both alloys BT-1-190 and BT-1-216 were atomized under conditions similar to those set forth in Example 1. With Nd-Fe-B type alloys, the Nd content of the alloy was observed to be decreased by about 1–2 weight % in the atomized powder compared to the melt as a result of melting and atomization, probably due to reaction of the Nd during melting with residual oxygen and formation of a moderate slag layer on the melt surface. The iron content of the powder increased relatively as a result while the B content remained generally the same. The initial melt composition can be adjusted to accommodate these effects.

FIG. 5 reveals that a majority of the as-atomized powder particles fall in the particle size (diameter) range of less than 45 microns, even more particularly less than 38 microns (i.e.,–38 on the abscissa). In particular, greater than 60% (about 66– 68%) by weight of the particles exhibit particle diameter of less than 38 microns found to exhibit optimum magnetic properties in the as-atomized condition as will become apparent. These weight distributions were determined by hand sifting (screening) an entire batch of powder through a full range of ASTM woven wire screens.

Figure 7:
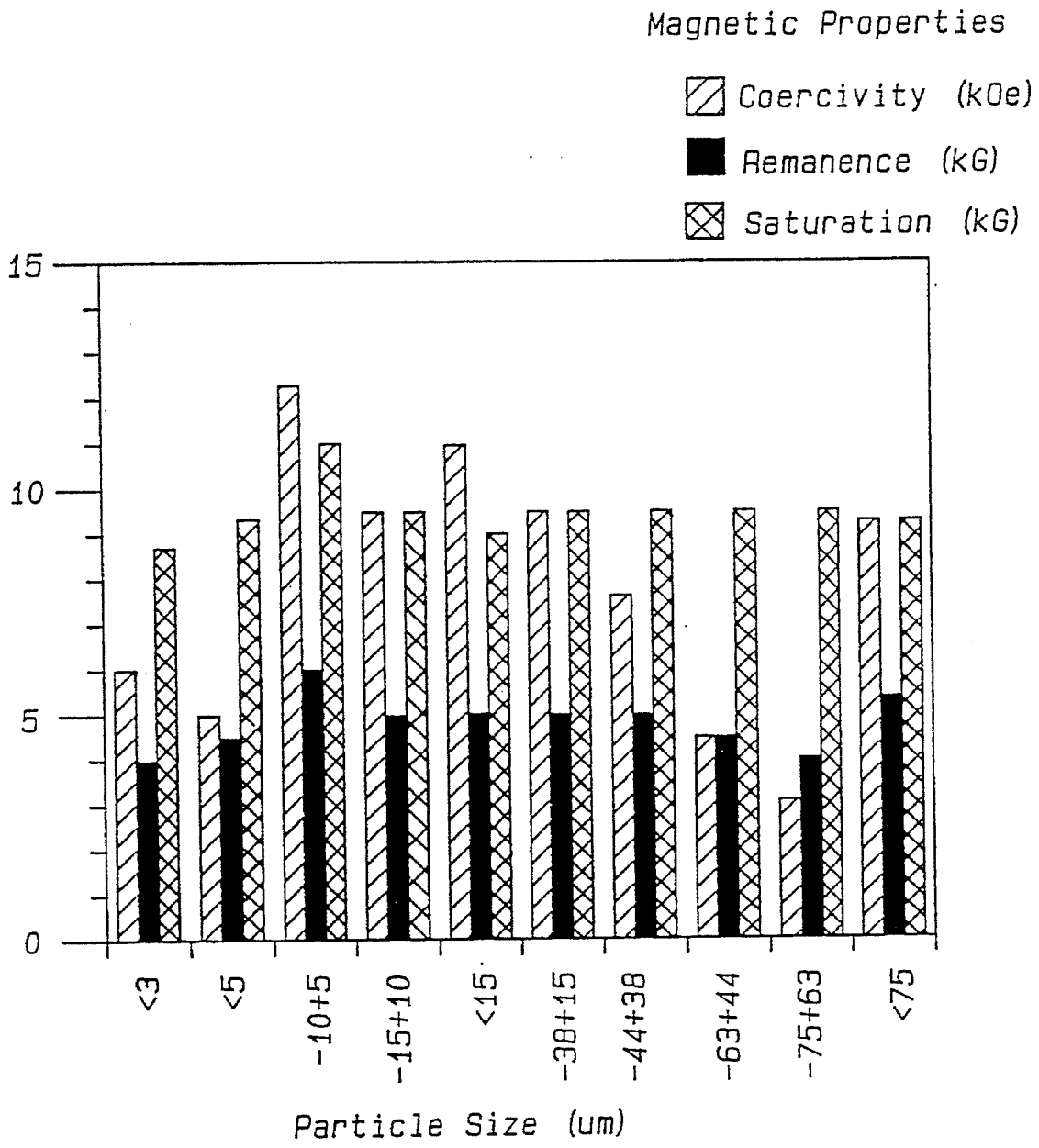
FIG. 7 is a bar graph illustrating the magnetic properties of as-atomized Nd-Fe-B alloy particles as a function of particle size.
Figure 8:
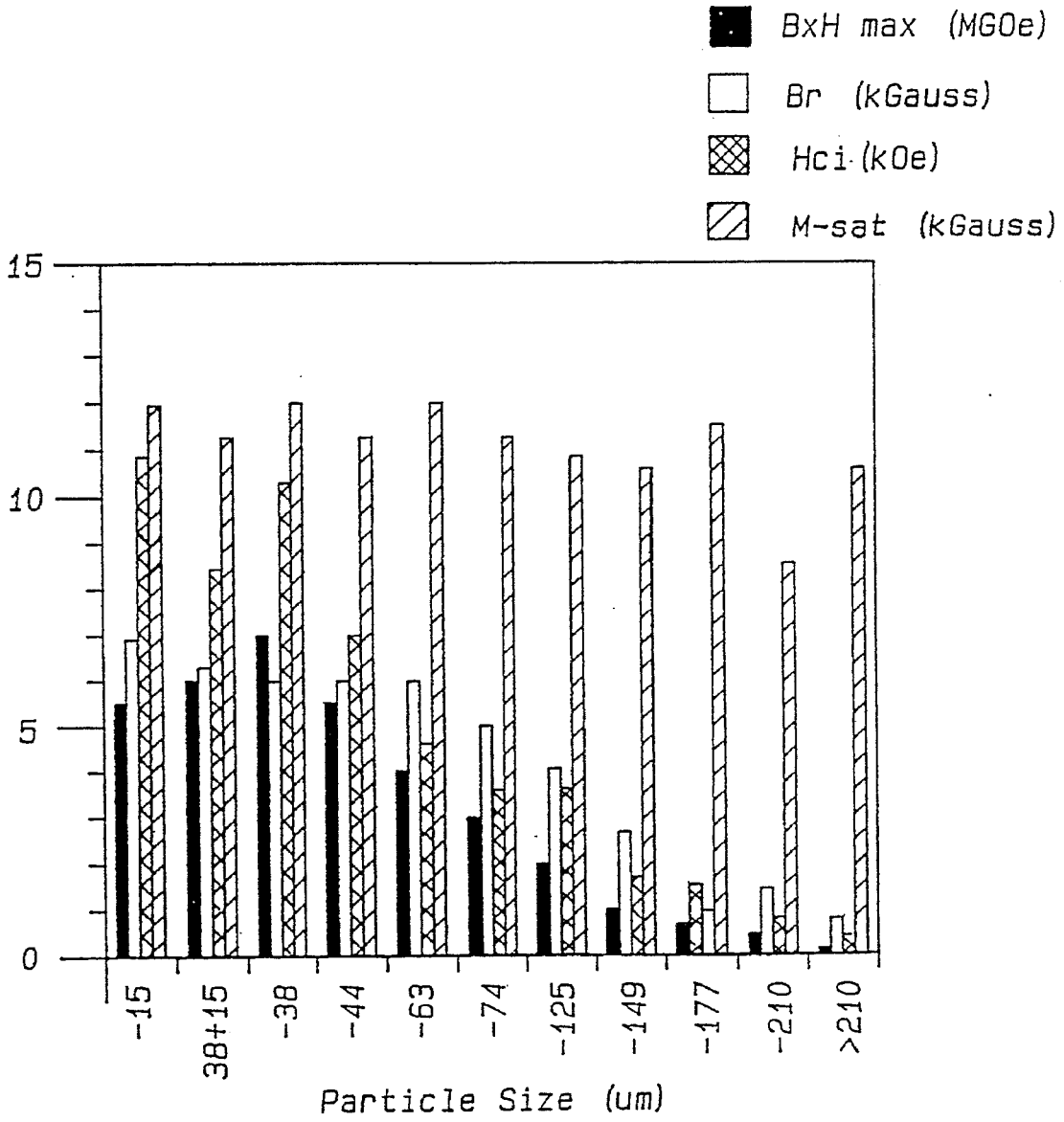
FIG. 8 is a similar bar graph for Nd-Fe-B-La alloy particles.
Figure 10:
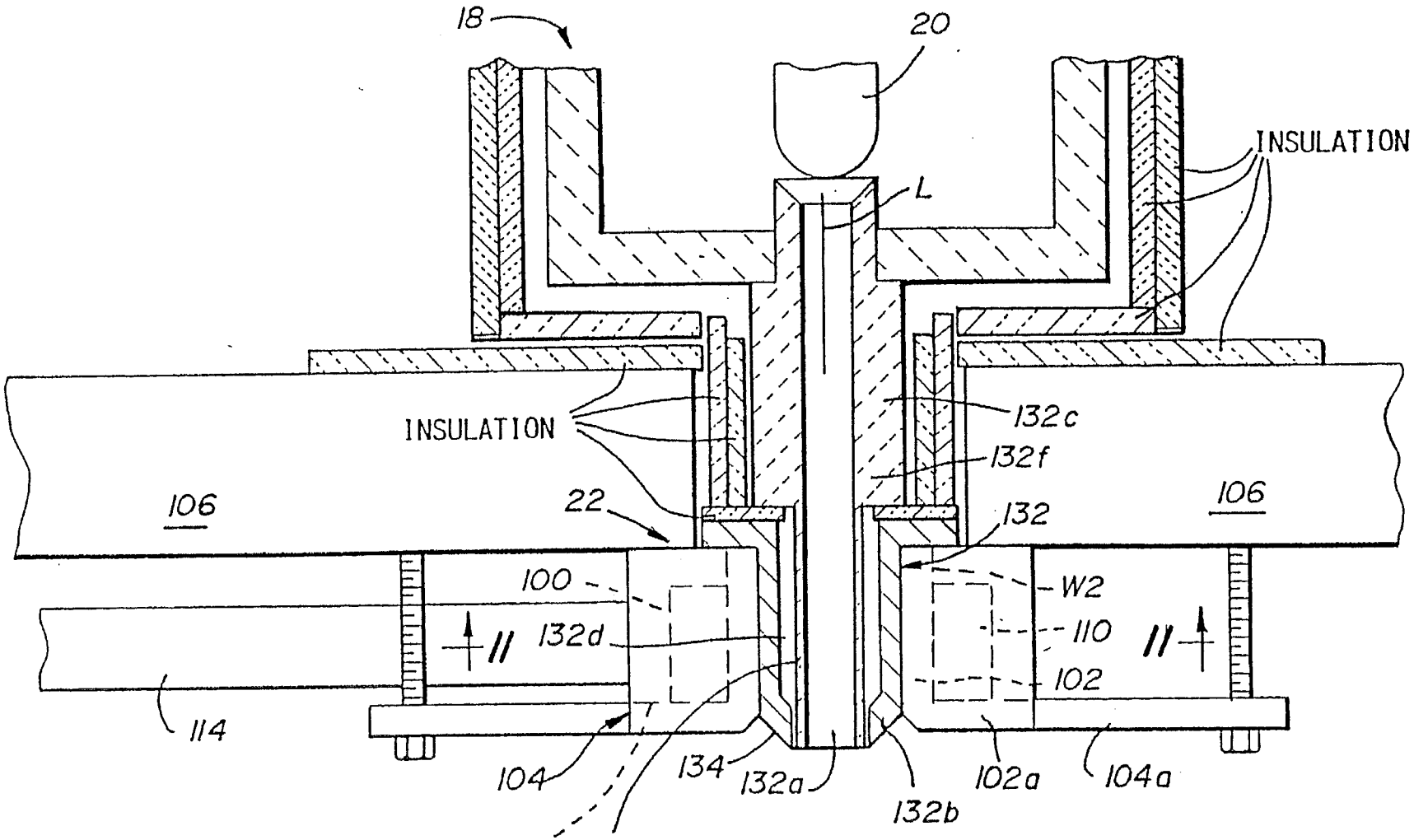
FIG. 10 is a side elevation of a modified atomizing nozzle used in the Examples.
Figure 11:
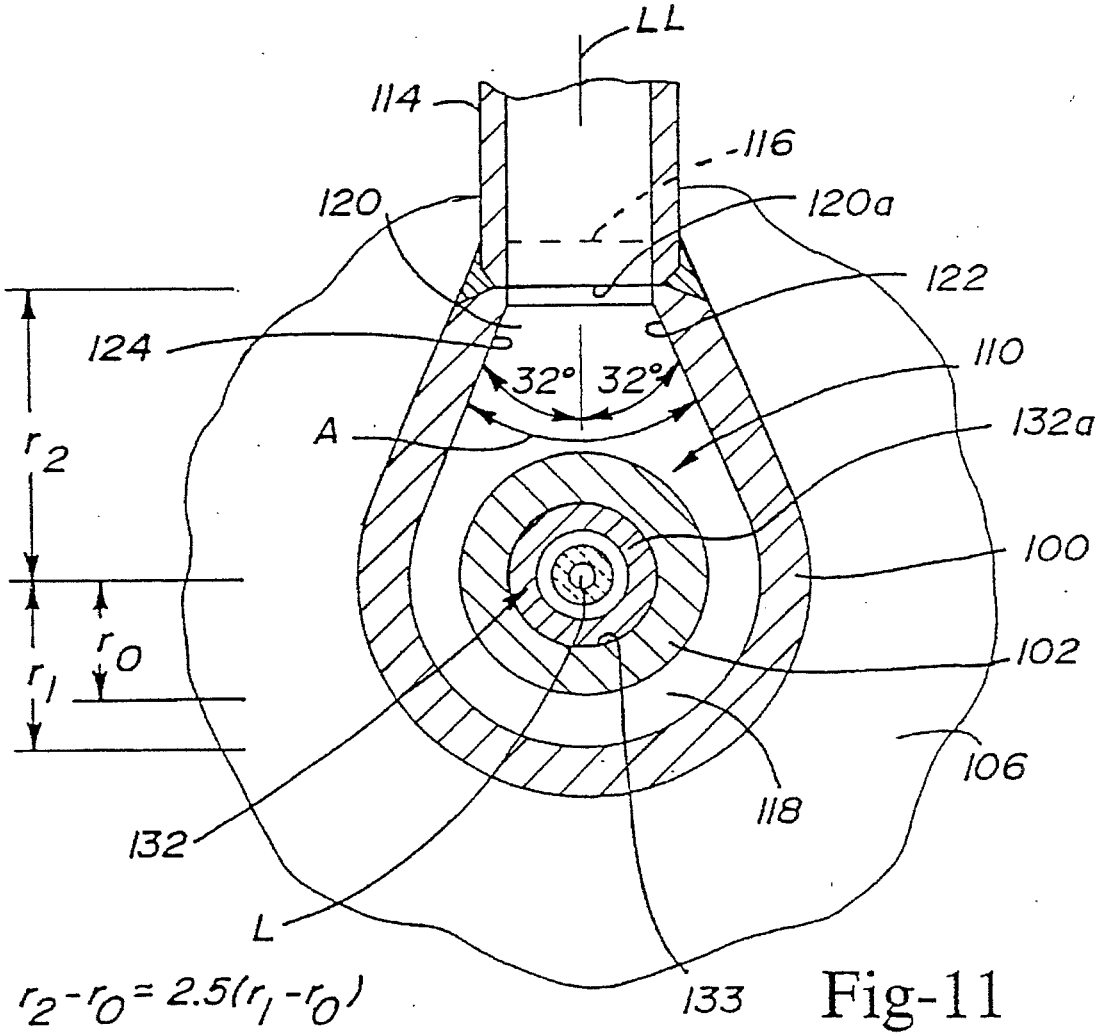
FIG. 11 is a sectional view of the modified atomizing nozzle along lines 11—11.
Figure 13:
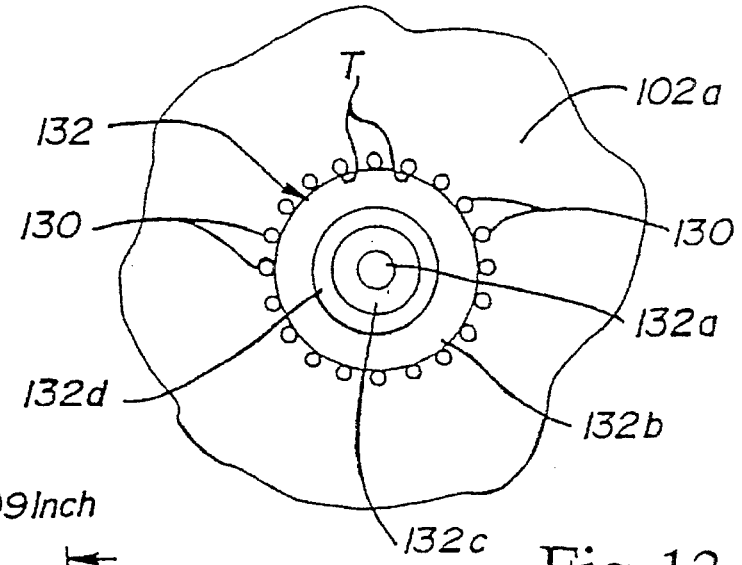
FIG. 13 is a bottom plan view of the modified atomizing nozzle.
Figure 12:
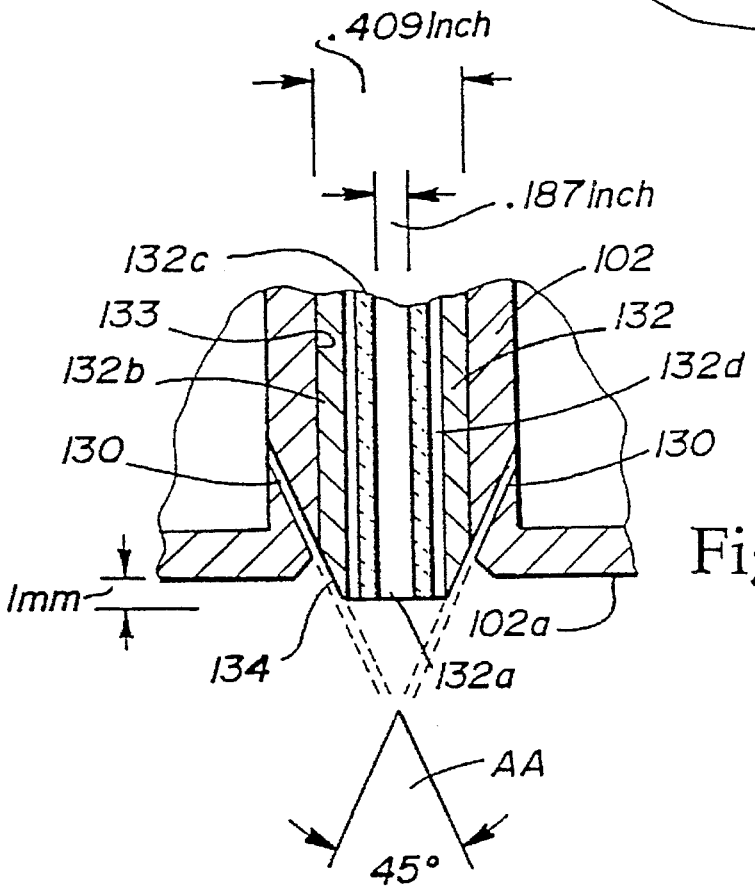
FIG. 12 is a view of the modified atomizing nozzle showing gas jet discharge orifices aligned with the nozzle tube surface.

The advantage, of producing the alloy powder particles in the manner described above is evident in FIGS. 6 and 7. In FIGS. 6 and 7, the magnetic properties (namely, coercivity, remanence and saturation) of as-atomized powder as a function of particle size is set forth for alloy BT-1-162 (32.5 weight % Nd-66.2 weight % Fe-1.32 weight % B, FIG. 6) and the aforementioned alloy BT-1-190 (FIG. 7). The alloys were atomized under like conditions similar to those set forth in Example 1. The Figures demonstrate that coercivity and, to a lesser extent, remanence appear to vary as a function of particle size in both alloys. Elevated levels of coercivity and remanence are observed in both alloys as particle size (diameter) is reduced below about 38 microns. On the other hand, saturation magnetization of both alloys remains relatively constant over the range of particle sizes. For alloy BT-1-162, the coercivity falls significantly as particle size is reduced below about 5 microns. These results correlate with grain size measurements which reveal a continuous decrease in grain size with reduced particle size; e.g., from a grain size of about 500 nm for 15–38 micron particles to about 40–70 nm for less than 5 micron particles; for example, as shown in FIG. 8 for alloy BT-1-162. Magnetic property differences between powder size classes were due to differences in the microcrystalline grain size within each particle.

From FIGS. 6 and 7, it is apparent that the magnetic properties, particularly the coercivity, of the alloy powder increase with decreased particle size to a maximum of about 10–11 kOe for powder particles of about 15–38 microns diameter, and then decrease for particles of further reduced size. Moreover, it is apparent that near optimum overall magnetic properties are exhibited by the as-atomized alloy particles in the general particle size (diameter) range of about 3 microns to about 44 microns and, more particularly, about 5 to about 40 microns where the majority of the particles are produced by the high pressure inert gas atomization process described above. Thus, the yield of as-atomized powder particles possessing useful magnetic properties is significantly enhanced in practicing the invention as described above.

Typically, in the above-described embodiment of the invention, each batch of alloy particles produced using the high pressure inert gas atomization process of Example 1 is initially size classified by, for example, sifting (screening) through an ASTM 44 micron woven wire mesh screen. This preliminary size classifying operation substantially removes particles greater than 44 microns diameter from the batch and thereby increases the percentage of finer particles in each batch. This preliminary screening operation is conducted in a controlled atmosphere (nitrogen) glove box after the contents of the sealed powder container, FIG. 2, are opened in the glove box.

Referring again to FIG. 1, in another embodiment of the invention, the rapidly solidified powder produced by the high pressure inert gas atomization process is subjected to the preliminary size classifying (screening) operation described above and also to one or more additional size classifying operations to form one or more particle size fractions or classes wherein each fraction or class comprises powder particles having a particle size (diameter) in a given relatively narrow range. For example, for a typical batch of high pressure inert gas atomized Nd-Fe-B powder (e.g., BT-1-162 described above), the following particle size fractions or classes having the listed range of particle sizes (diameters) are provided by carrying out an air classifying operations on the batch using an air classifying procedure to be described:

Fraction #1—about 38 to about 15 microns (diameter)
Fraction #2—about 15 to about 10 microns (diameter)
Fraction #3—about 10 to about 5 microns (diameter)
Fraction #4—about 5 to about 3 microns (diameter)

In particular, the rapidly solidified powder particles were air classified using a commercially available air classifier sold as model A-12 under the name Majac Acucut air classifier by Hosokawa Micon International Inc., 10 Chantham Rd., Summit, N.J. In producing the particle size fractions #1, #2, #3 and #4 described above, the rapidly solidified powder was air classified using a blower pressure of 135 inches water, an ejector pressure of 50 psi with rotor speeds of 507 rpm, 715 rpm, 1145 rpm and 1700 rpm to yield the particle size fractions #1, #2, #3 and #4, respectively.

As is apparent, in any given particle size fraction or class, the powder particles fall within a given narrow range of mean particle sizes (diameters). As a result, the powder particles in each particle size fraction or class exhibit a rapidly solidified microstructure, especially grain size, also within a very narrow range. In this way, the classifying operation is effective to provide isotropic magnetic article properties. For example the following grain size ranges were observed for each particle size fraction:

Fraction #1—about 490 nm to about 500 nm grain size
Fraction #2—about 210 nm to about 220 nm grain size
Fraction #3—about 115 nm to about 130 nm grain size
Fraction #4—about 60 nm to about 75 nm grain size A plurality of particle size (air) fractions or classes having quite uniform particle microstructures (grain sizes) within each fraction or class are thereby provided by the size classifying operation depicted in FIG. 1. Depending upon the particular magnetic properties desired in the magnet, a particular particle size fraction or class having the appropriate microstructure can then be selected to this end for further processing in accordance with the invention to produce the desired magnet. A different particle size fraction or class can be chosen for further processing in accordance with the invention in the event slightly different magnetic/mechanical properties are specified by the magnet user or manufacturer.

Referring to FIG. 1, the alloy powder particles, either as initially size classified (screened) in accordance with the first embodiment of the invention, as air classified in accordance with the second embodiment of the invention or as-atomized, are then mixed or blended with a thermally responsive, low viscosity binder, such as a thermoplastic or thermosetting polymeric binder, to provide a feedstock that can be formed (molded) to desired shape under relatively low heat and pressure (e.g., injection molding conditions). The binder and the alloy powder are mixed in proportions dependent upon the alloy powder employed, the binder employed as well as the desired volume loading of magnetic powder particles in the feedstock. High volume loadings of powder in the binder are achievable as a result of the fine, spherical powder particles produced by the high pressure inert gas atomization process. For example, powder volume loadings of about 75 to about 80 volume % are possible in practicing the invention. However, the invention is not so limited and may be practiced to make powder-filled polymers having less than 50 volume % powder therein depending on the magnet properties desired. Blends of particles of different sizes can be used to achieve optimal volume loading.

The low viscosity binder may be selected from certain materials which are effective to wet and bond the outer, carbon-bearing layer on the powder particles under the particular molding conditions involved. Binders useful in practicing the present invention are generally characterized as having low viscosity (e.g., 100 to 10 Pas for a specified shear rate of 50 to 500 mm per mm per second). The binder may include a coupling agent, such as glycerol, titanate, stearic acid, polyethylene glycol, polyethylene oxide, humic acid, ethoxylated fatty acid and other known coupling/processing aid agents to achieve higher loading of powder in the binder. Binders exhibiting such properties include 66 weight % PE#1 (Grade 6 polyethylene homopolymer sold by Allied Corp., Morristown, N.J.) and 33 weight % PE#2 (Clarity linear low density polyethylene Grade 5272—See ASTM NA153 or, alternately PE#2 may comprise PE2030 (#38645) available from CFC Prime Alliance, Des Moines, Iowa), 64 weight % PE#1—30 weight % PE#2—5 weight % stearic acid (Grade A-292 sold by Fisher Scientific Co.), 75 weight % PE#1—25 weight % PE#2, 72 weight % PE#1—23 weight % PE#2—5 weight % stearic acid, 44 volume % corn oil—54 weight % polystyrene—4.7 volume % stearic acid, 65 weight % PE#1—32 weight % PE#2—2 weight % LICA-12 (a titanate available from Kenrich Petrochemcial Corp.), and polystyrene (1.045 gm/cc available from Huntsman Chemical Company, Salt Lake City, Utah). A Teflon® (Grade 7A available from DuPont) binder is useful for compression molding.

A preferred low viscosity binder for use in the invention comprises a mixture of a high melt flow, short chain low molecular weight polyethylene (e.g., PE#1—melting point of 106° C.) and a stronger, moderate melt flow, low molecular weight polyethylene (e.g., PE#2—softening point of about 130° C.) preferably in a 2-to-1 volume % ratio, as set forth in the Examples.

The binder and the alloy powder are typically mixed or blended by moderate to high shear mixing to provide a homogeneous, low viscosity feedstock. The feedstock viscosity typically is selected in the range of about 10 to about 100 Pas for the injection molding process described in the Examples set forth hereinbelow. Of course, the particular viscosity level used will depend on the particular binder employed, the powder employed and powder volume loading employed as well as the type of molding process employed.

Molding of the low viscosity feedstock is typically effected by injection molding using equipment currently employed in the plastic industry to injection mold metal-filled polymers; e.g., as described in by R. M. German, Powder Injection Molding, Metals Powder Industry Federation, Princeton, N.J. 1990, the teachings of which are incorporated herein by reference. Highly complex three dimensional shapes can be formed by injection molding into a suitable die or molding cavity. However, the invention is not limited to such injection molding processes and may be practiced using blow molding, extrusion, co-extrusion, transfer molding, rotational molding, compression molding, stamping and other low viscosity forming processes.

Injection molding is typically conducted under relatively low temperature and pressure conditions such as, for example, a temperature of about 25° to about 170° C. and injection pressures of about 50 to about 3000 psi. The molding temperature is selected to melt the lowest melting point binder constituent (e.g., PE#1 described above) while softening the other binder constituent (e.g., PE#2 described above). Of course, the molding parameters employed will depend upon the particular molding process used as well as the binder and powder types and volume loading used. Higher pressures are needed for more complex mold cavity geometry and runner and gating systems. Molding time will also vary depending on these same factors. Once the magnet compact is molded to shape, it is cooled to 25° to 50° C. and removed from the molding die whereupon the binder maintains the molded shape.

After the molding operation, the magnet compact may be used as a bonded magnet with minimal finishing operations such as coating the magnet with teflon for environmental protection purposes. For bonded magnets, the as-molded compact will correspond closely in shape to the desired magnet configuration for the intended service application so that little or no machining is required. Alternately, the binder may be removed from the molded compact by a controlled thermal cycle or chemical cycle and then the binderless compact is sintered to near full density. If the binder comprises the 2 to 1 mixture of PE#1 and PE#2 described hereinabove, the binder can be removed by heating to 550° C. in a protective atmosphere, such as argon or vacuum ($10^{-6}$ torr), to protect the magnet alloy powder from oxidation, for an appropriate time to burn out the binder. The same binder can also be removed chemically by solvent condensation-evaporation using heptane at 60° C. as described in "The Effects of Binder on the Mechanical Properties of Carbonyl Iron Products", K. D. Hens, S. T. Lin, R. M. German and D. Lee, *J. of Metals,* 1989, Vol. 41, No. 8, pp. 17–21, the teachings of which are incorporated herein by reference. If the binder is thusly removed, the compact will undergo some shrinkage which must be taken into consideration in dimensioning the injection molding die so that the desired size of sintered magnet is ultimately produced.

Bonded magnets made in accordance with the invention typically exhibit energy products (BHmax) of about 3 to about 6 MGOe. Sintered magnets of the invention typically exhibit energy products of about 5 to about 8 MGOe.

The following Examples are offered to illustrate, but not limit, the invention.

EXAMPLE 1

The melting furnace of FIG. 2 was charged with an Nd-16 weight % Fe master alloy as-prepared by thermite reduction, an Fe-B alloy carbo-thermic processed and available from Shieldalloy Metallurgical Corp., and electrolytic Fe obtained from Glidden Co. The quantity of each charge constituent was controlled to provide a melt composition of about 33.0 weight % Nd- 65.9 weight % Fe- 1.1 weight % B. The charge was melted in the induction melting furnace after the melting chamber and the drop tube were evacuated to $10^{-4}$ atmosphere and then pressurized with argon to 1.1 atmospheres. The melt was heated to a temperature of 1650° C. After a hold period of 10 minutes to reduce (vaporize) Ca present in the melt (from the thermite reduced Nd-Fe master alloy) to melt levels of 50–60 ppm by weight, the melt was fed to the atomizing nozzle by gravity flow upon raising of the stopper rod. The atomizing nozzle 22 was of the type described in U.S. Pat. No. 4,619,845 as modified (see FIGS. 10–13) to include (a) a divergent manifold expansion region 120 between the gas inlet 116 and the arcuate manifold segment 118 and (b) an increased number (i.e., 20) of gas jet discharge orifices 130 that are NC machined to be in close tolerance tangency T (e.g., within 0.002 inch, preferably 0.001 inch) to the inner bore 133 of the nozzle body 104 to provide improved laminar gas flow over the frusto-conical surface 134 of the two-piece nozzle melt supply tube 132 (i.e., inner boron nitride melt supply tube 132*c* and outer Type 304 stainless steel tube 132*b* with thermal insulating space 132*d* therebetween). The divergent expansion region 120 minimizes wall reflection shock waves as the high pressure gas enters the manifold to avoid formation of standing shock wave patterns in the manifold, thereby maximizing filling of the manifold with gas. The manifold had an $r_0$ of 0.3295 inch, $r_1$ of 0.455 inch and $r_2$ of 0.642 inch. The number of discharge orifices 130 was increased from 18 (patented nozzle) to 20 but the diameter thereof was reduced from 0.0310 inch (patented nozzle) to 0.0292 inch to maintain the same gas exit area as the patented nozzle. The modified atomizing nozzle was found to be operable at lower inert gas pressure while achieving more uniformity in the particles sizes produced; e.g., to increase the percentage of particles falling in the desired particle size range (e.g., less than 38 microns) for optimum magnetic properties for the Nd-Fe-B alloy involved from about 25 weight % to about 66–68 weight %. The yield of optimum particle sizes was increased to improve the efficiency of the atomization process. The modified atomizing nozzle is described in copending U.S. patent application entitled "Improved Atomizing Nozzle and Process" (attorney docket no. ISURF 1250-A), the teachings of which are incorporated herein by reference.

Argon atomizing gas at 1050 psig was supplied to the atomizing nozzle in accordance with the aforementioned patent. The reactive gas jet was located 75 inches downstream of the atomizing nozzle in the drop tube. Ultra high purity (99.95%) nitrogen gas was supplied to the jet at a pressure of 100 psig for discharge into the drop tube to establish a nitrogen gas reaction zone or halo extending across the drop tube such that substantially all the droplets traveled through the zone. At this downstream location from the atomizing nozzle, the droplets were determined to be at a temperature of approximately 1000° C. or less, where at least a finite thickness solidified exterior shell was present thereon. After the droplets traveled through the reaction zone, they were collected in the collection container of the collection chamber (see FIG. 2). The solidified powder product was removed from the collection chamber when the powder reached approximately 22° C.

The powder particles comprised a core having a particular magnetic end-use composition, an inner protective refractory layer and an outer carbonaceous (graphitic carbon) layer thereon. The reaction product layer formed on the rare earth-transition metal alloy powder is limited so as not to exceed about 500 A, preferably being in the range of about 200 to about 300 angstrom. Auger electron spectroscopy (AES) was used to gather surface and near surface chemical composition data on the particles using in-situ ion milling to produce a depth profile. The AES analysis indicated an inner surface layer enriched in nitrogen, boron and Nd corresponding to a mixed Nd-B nitride (refractory reaction product). The first inner layer was about 150 to about 200 angstroms in thickness. A second inner layer enriched in Nd, Fe, and oxygen was detected atop the nitride layer. This second layer corresponded to the mixed oxide of Nd and Fe (refractory reaction product) and is believed to have formed as a result of decomposition and oxidation of the initial nitride layer while the powder particles were still at elevated temperature. The second layer was about 100 angstroms in thickness. An outermost third layer of graphitic carbon was also present on the particles. This outermost layer was comprised of graphitic carbon with some traces of oxygen and had a thickness of at least about 3 monolayers. This outermost carbon layer is believed to have formed as a result of thermal decomposition of the Duco® cement (used to hold the splash member 12*c* in place) and subsequent deposition of carbon on the hot particles after they passed through reactive gas zone H so as to produce the graphitic carbon film or layer thereon. Subsequent atomizing runs conducted with and without excess Duco cement present confirmed that the cement was functioning as a source of gaseous carbonaceous material for forming the graphite layer on the particles. The Duco cement is typically present in an amount of about one (1) ounce for atomization of a 4.5 kilogram melt to produce the graphite coating on the particles.

Figure 4A:
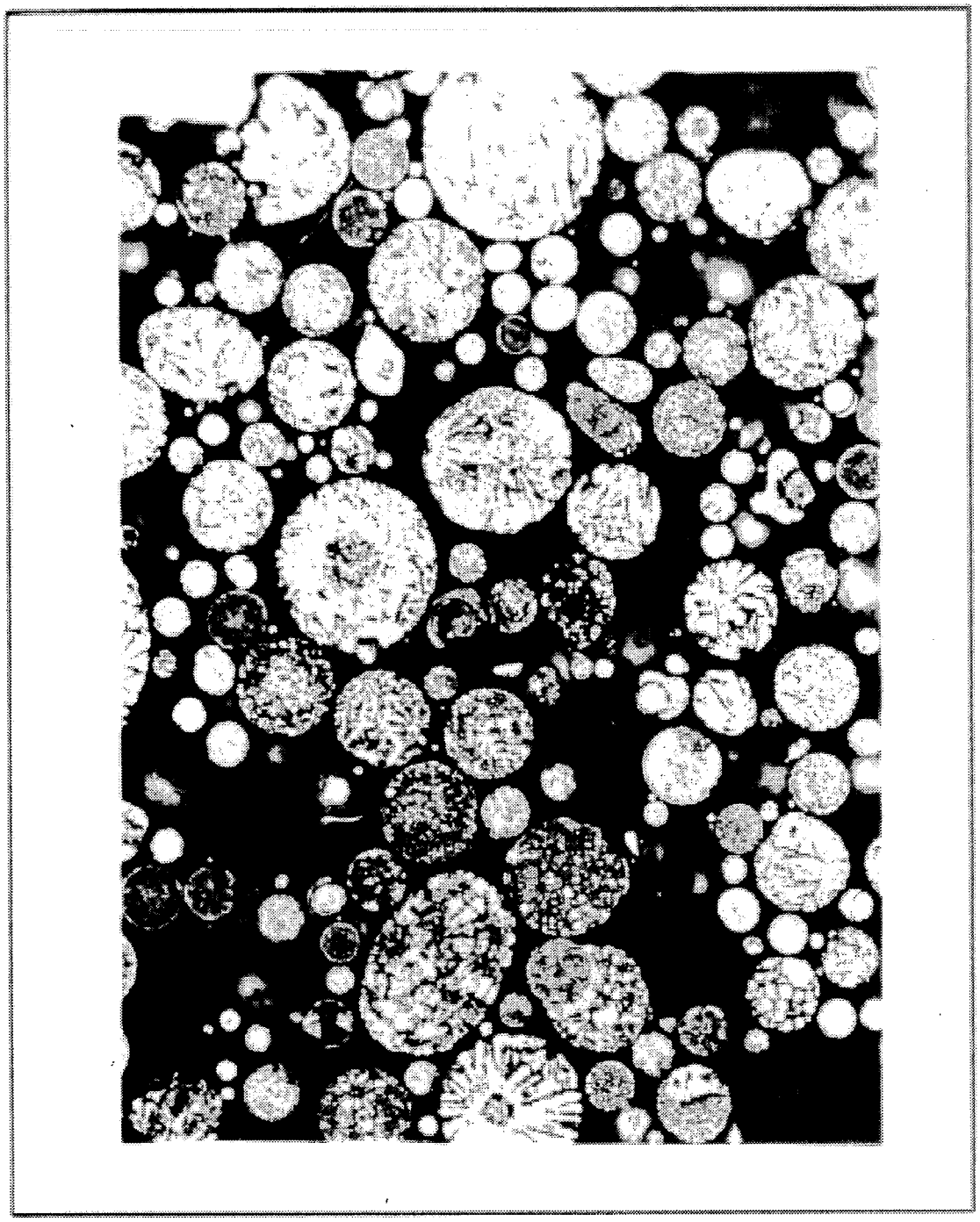
FIGS. 4A and 4B are photomicrographs at 1000× of a section of a bonded isotropic permanent magnet made in accordance with Example 1 and exhibiting a homogeneous microstructure and isotropic magnetic properties.
Figure 4B:
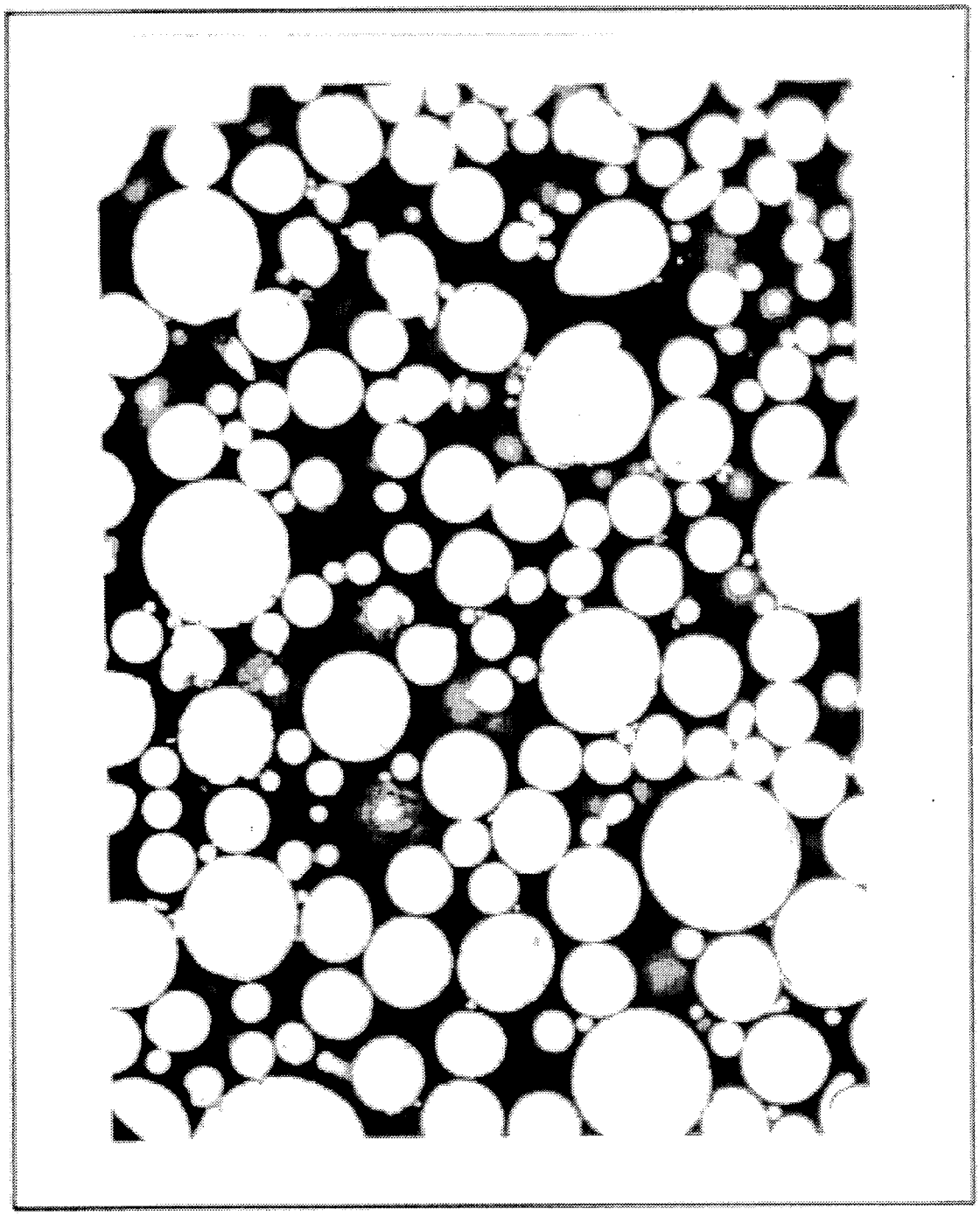

The collected powder particles ranged in size from about 1 to about 100 microns with a majority of the particles being less than about 38 microns in diameter. The powder particles were first screened using ASTM 44 micron woven wire mesh and then air classified into a particle size fraction where the particle diameters were less than 15 microns. A portion of this high pressure gas atomized powder (HPGA powder) was mixed with two different binders (see Table 1A) and molded into 3.65 inch diameter disks with each disk having two concentric recessed rings formed therein to a recess depth of 0.15 inch and radii of 1.675 and 1.017 inches. This disk geometry was selected as a demonstration of a shape that would be very difficult to make with conventional press and sinter processes. The molding was conducted at 140° C. and injection pressure of 50 psi in a laboratory scale, plunger type injection molding apparatus. Table 1A provides a description of the molding results. The bonded magnet compact produced using the different binders exhibited magnetic properties set forth in Table 1B. FIG. 4A,B illustrates the microstructure of the bonded magnet produced.

TABLE 1A

Lab Scale Injection Molding Using A vertical Plunger Molder

| Mixture | Comments |
|---|---|
| 50 vol. %-PE#1<br>50 vol. %-HPGA Powder (−15 microns) | Powder/binder was mixed well. The as molded 3" disk was too brittle to be ejected using the pin configuration without flow lines and cracks. No distortion was observed. |
| 50 vol. % (66 wt. % PE#1–33 wt. % PE#2)<br>50 vol. %-HPGA powder (<15 microns) | Polymers were precompounded and mixed well with powder. The an molded 3" disk had much more elasticity during shrinkage and ejection from the mold. Good molding conditions resulted in an undistorted, crack-free disk. |

TABLE 1B

| | BHmax (MGoe) | Coercivity (kOe) | Remanence (kGauss) | Saturation (kGauss) |
|---|---|---|---|---|
| Sample 1 | 4.6 | 3.0 | 5.8 | 11.0 |
| Sample 2 | 6.7 | 7.5 | 6.3 | 12.0 |

EXAMPLE 2

A portion of the air classified powder of Example 1 was mixed with the PE#1/PE#2 binder (66.6 weight % PE#1/33.3 weight % PE#2) but in a different volumetric proportion relative to the HGPA powder as set forth in Table 2A (i.e., 35 vol. % PE#1/PE#2 binder versus 65 vol. % HPGA powder). The mixture was molded to the aforementioned disk configuration using the same molding equipment/parameters described above for Example 1. The molded compact was debound (i.e., binder removed) by heating to 550° C. at 1° C./min and then sintered at 800° C. for 1 hour under an inert atmosphere. The sintered magnet compact exhibited magnetic properties set forth in Table 2B. FIG. 5 illustrates the microstructure of the sintered magnet produced.

TABLE 2A

Lab Scale Injection Molding Using A Vertical Plunger Molder

| Mixture | Comments |
|---|---|
| 35 vol. % (66 wt. % PE#1–33 wt. % PE#2) 65 vol. %-HPGA powder –15 microns | Polymer and powder blended well. However, the mixture was more viscous and was not resistant to thermal cracking, cooling and shrinkage in the mold. |

EXAMPLE 3

A batch of powder particles was atomized from a melt comprising 34.7 weight % Nd- 63.89 weight % Fe- 1.31 weight % B, screened and air classified into particle size fraction less than 15 microns similar to Example 1. This particle size fraction was mixed with the PE#1/PE#2 binder/mixture set forth in Table 1 in a 50—50 volume percentage basis of the PE#1/PE#2 binder to HPGA powder. The mixture of binder and powder particles was then injection molded as in Example 1 to the disk geometry described there. Table 3A provides a description of the mold results. The magnetic properties of the bonded magnetic compact are set forth in Table 3B.

TABLE 3A

Lab Scale Injection Molding Using A Vertical Plunger Mold

| Mixture | Comments |
|---|---|
| 50 vol. % (66 wt. % PE#1–33 wt. % PE#2) 50 vol. % HPGA Powder (–15 microns) | Powder and binder blended well and molded well |

TABLE 3B

| | BHmax (MGOe) | Coercivity (kOe) | Remanence (kGauss) | Saturation (kGauss) |
|---|---|---|---|---|
| Sample 3 | 2.09 | 4.5 | 4.58 | 8.7 |

In Examples 1–3, the powder particles were air classified to less than 15 microns diameter. Powder particles classified in the size range of 15–38 microns in diameter are believed to offer optimum magnetic properties (e.g., as shown in FIGS. 7–8) and thus should provide improved magnetic properties for bonded/sintered magnet compacts produced by similar Examples.

EXAMPLE 4

A batch of powder particles was atomized from a melt comprising 31.5 weight % Nd- 65.5 weight % Fe- 1.408 weight % B- 1.592 weight % La and classified into particle size fraction of less than 38 microns to 15 microns. This particle size fraction was mixed with Teflon (polytetrafluoroethylene—Grade 7A sold by DuPont, Wilmington, Del.) in a volume proportion of 60 volume % powder to 40 volume % Teflon. The mixture of binder and powder was then compression molded at 180°–220° C. to a 1 inch diameter by 0.25 inch thick disk. The following Table 4 sets forth the magnetic properties.

TABLE 4

| BHmax (MGOe) | Coercivity (kOe) | Remanence (kGauss) | Saturation (kGauss) |
|---|---|---|---|
| 2.23 | 6.2 | 3.75 | 7.39 |

EXAMPLE 5

Batches of powder particles were also successfully molded to form 6 inch diameter by 6 inch long hollow cylinders having a wall thickness of 0.2 inch. The first batch was atomized from a melt comprising 33.0 weight % Nd- 65.9 weight % Fe- 1.1 weight % B, and the second batch from a melt comprising 32.6 weight % Nd- 50.94 weight % Fe- 1.22 weight % B- 14.1 weight % Co- 1.05 weight % Ga. Each batch was atomized and classified into particle size fraction of less than 38 microns to 15 microns. Each particle size fraction was mixed with Teflon (Grade 7A) in a 60:40 volume % ratio of powder to Teflon. The mixture was then rotational molded at 170° C. and 800 rpm to successfully form the hollow cylinders.

While the invention has been described in terms of specific embodiments thereof, it is not intended to be limited thereto but rather only to the extent set forth hereafter in the following claims.

We claim:

1. An isotropic permanent magnet, comprising a binder and atomized generally spherical rare earth-transition metal alloy particles in the binder, said atomized particles having a carbon layer formed on individual atomized particles.

2. The magnet of claim 1 wherein the binder comprises a polymeric binder.

3. The magnet of claim 2 wherein the polymeric binder includes an olefin polymer component.

4. The magnet of claim 3 wherein the polymeric binder comprises a mixture of a first, high melt flow polyethylene and a second, stronger, moderate melt flow polyethylene.

5. The magnet of claim 1 wherein the alloy powder particles comprise a rare earth-iron-boron alloy.

6. The magnet of claim 5 wherein the rare earth is Nd.

7. The magnet of claim 1 wherein a majority of the particles have a diameter less than about 38 microns.

8. The magnet of claim 1 wherein the carbon layer comprises graphitic carbon.

* * * * *